US005586676A

United States Patent [19]

Lynd

[11] Patent Number: 5,586,676

[45] Date of Patent: Dec. 24, 1996

[54] BEVERAGE CONTAINER CAP WITH STIRRER

[75] Inventor: L. Grant Lynd, Canal Winchester, Ohio

[73] Assignee: National Packaging Corporation, Columbus, Ohio

[21] Appl. No.: 546,337

[22] Filed: Oct. 20, 1995

[51] Int. Cl.[6] ..... B65D 41/56

[52] U.S. Cl. ..... 220/212; 220/703; 220/735; 215/228; 215/387; 215/390

[58] Field of Search ..... 220/212, 703, 220/735; 215/228, 387, 390, 391

[56] References Cited

U.S. PATENT DOCUMENTS

| | | | |
|---|---|---|---|
| 2,175,735 | 10/1939 | Banks | 215/228 X |
| 2,485,303 | 10/1949 | Marcus | 220/735 X |
| 4,717,032 | 1/1988 | Wu | 215/228 |

FOREIGN PATENT DOCUMENTS

| | | | |
|---|---|---|---|
| 537851 | 5/1922 | France | 220/735 |
| 1181715 | 6/1959 | France | 220/735 |

*Primary Examiner*—Stephen Cronin
*Attorney, Agent, or Firm*—Biebel & French

[57] ABSTRACT

A drinking container cap is provided having an exterior surface, and an interior surface, with the interior surface having a stirrer depending downwardly therefrom. Preferably the interior surface has formed thereon a stirrer receptacle, with the stirrer receptacle itself being generally cylindrical. The stirrer mechanically engages with the stirrer receptacle, and is detachable therefrom. The stirrer receptacle has an inner and an outer surface, with an indentation in its inner surface. The stirrer has a shank end and a terminal end, with the shank end having a bulged area which engages with the indentation, and the terminal end having a bowl portion. In the preferred embodiment of the invention the stirrer receptacle has two notches formed therein, and the stirrer has two projections extending outwardly from the shank end, with the notches being on opposite sides of the stirrer receptacle and the projections being on opposite sides of the stirrer.

16 Claims, 4 Drawing Sheets

2
10
15
23
19
21
20
25
2

BEVERAGE CONTAINER CAP WITH STIRRER

BACKGROUND OF THE INVENTION

The present invention relates generally to beverage containers caps, and more particularly to such devices which have a stirrer attached thereto.

Beverage containers have enjoyed a proliferation in the marketplace. This is especially true of plastic beverage containers. Over the past couple of decades, sales of plastic squeeze bottles and newly designed plastic cups have soared. One reason why plastic cup sales have shown such strong growth is related to the increased frequency of finding beverage holders in automotive vehicles.

Convenience stores and fast-food establishments have marketed the accessibility and the desirability of enjoying a cup of coffee while driving. However, significant problems exist for coffee-drinking drivers. These problems result from having to stir the coffee upon the addition of cream and/or sugar. One significant problem relates to the accumulation and disposal of the attendant trash. Typical stirrers often have to be removed from a plastic sheath-like container, which container then has to be disposed of as trash. Then, following the stirring, the stirrer itself must be thrown away. If the user cannot readily dispose of the container and/or the stirrer the aesthetics of the vehicle's interior are compromised.

Another significant problem relates to those individuals who reuse their stirrer. This often occurs if a spoon is kept in the car especially for this purpose. However, instead of being thoroughly cleaned after each use, it is often left in the vehicle where it can be subjected to airborne contaminants. Additionally, whatever liquid is left on the spoon, whether it be coffee or saliva, provides a breeding ground for bacteria.

In addition to the above problems, a coffee drinker who uses cream and/or sugar is placed in a dilemma if he forgets or misplaces the stirrer. Then, fingers, keys, pens or pencils, or other equally unsanitary objects often are used as stirrers. Or, the liquid is sloshed around in a closed cup in the hope that the movement of the liquid will evenly distribute the sugar and/or cream.

It is thus apparent that the need exists for an improved beverage container cap for use with existing beverage containers, which beverage container caps obviate the problems associated with traditional stirrers.

SUMMARY OF THE INVENTION

The problems associated with prior drinking container caps are overcome in accordance with the present invention by the providing of a drinking container cap having an exterior surface, and an interior surface, with the interior surface having a stirrer depending downwardly therefrom. Preferably the interior surface has formed thereon a stirrer receptacle, with the stirrer receptacle being generally cylindrical. The stirrer mechanically engages with the stirrer receptacle, and is detachable therefrom.

The stirrer associated with this invention has a shank end and a terminal end, with the terminal end having a bowl portion. The stirrer receptacle has an inner and an outer surface, with an indentation in its inner surface. The shank end has a bulged area which engages with the indentation of the stirrer receptacle. The stirrer receptacle has at least one notch formed therein, and the stirrer has at least one projection extending outwardly from the shank end, with the projection configured to fit within the notch. Preferably there are two notches formed therein, and the stirrer has two projections extending outwardly from its shank end, with the notches being on opposite sides of the stirrer receptacle and the projections being on opposite sides of stirrer.

There is also disclosed a drink container cap having an exterior surface, and an interior surface, with the interior surface having a stirrer receptacle which engages with a stirrer. In the preferred embodiment of the invention the stirrer receptacle is generally cylindrical. Additionally, preferably the stirrer is detachable from the stirrer receptacle. The stirrer receptacle has an inner and an outer surface, with the stirrer receptacle also having an indentation in its inner surface. The stirrer has a shank end and a terminal end, with the shank end having a bulged area which engages with the indentation, and the terminal end preferably having a bowl portion.

Preferably the stirrer receptacle has at least one notch formed therein, and the stirrer has at least one projection extending outwardly from the shank end, with the projection configured to fit within the notch. In the preferred embodiment of the invention the stirrer receptacle has two notches formed therein, and the stirrer has two projections extending outwardly from the shank end. Moreover, the notches are on opposite sides of the stirrer receptacle and the projections are on opposite sides of the stirrer.

There is also disclosed a drink container cap having an exterior surface, and an interior surface, with the interior surface having a stirrer receptacle engaging with a stirrer. The stirrer receptacle has an inner and an outer surface, with the stirrer receptacle having an indentation in its inner surface. The stirrer has a shank end and a terminal end, with the shank end having a bulged area which engages with the indentation, and the terminal end having a bowl portion. Preferably the stirrer receptacle has two notches formed therein, while the stirrer has two projections extending outwardly from the shank end. The notches are on opposite sides of the stirrer receptacle and the projections are on opposite sides of the stirrer.

It is a primary object of the present invention to provide a drinking container cap which overcomes the problems with stirrers.

It is also an object of the present invention to provide a drinking container cap which is relatively inexpensive to fabricate, and which can be used with existing drinking containers.

It is also an object of the present invention to provide a stirrer which is reusable, thus cutting down on problems with trash.

Other objects and advantages of the invention will be apparent from the following description, the accompanying drawings and the appended claims.

DETAILED DESCRIPTION OF THE INVENTION

Figure 1:
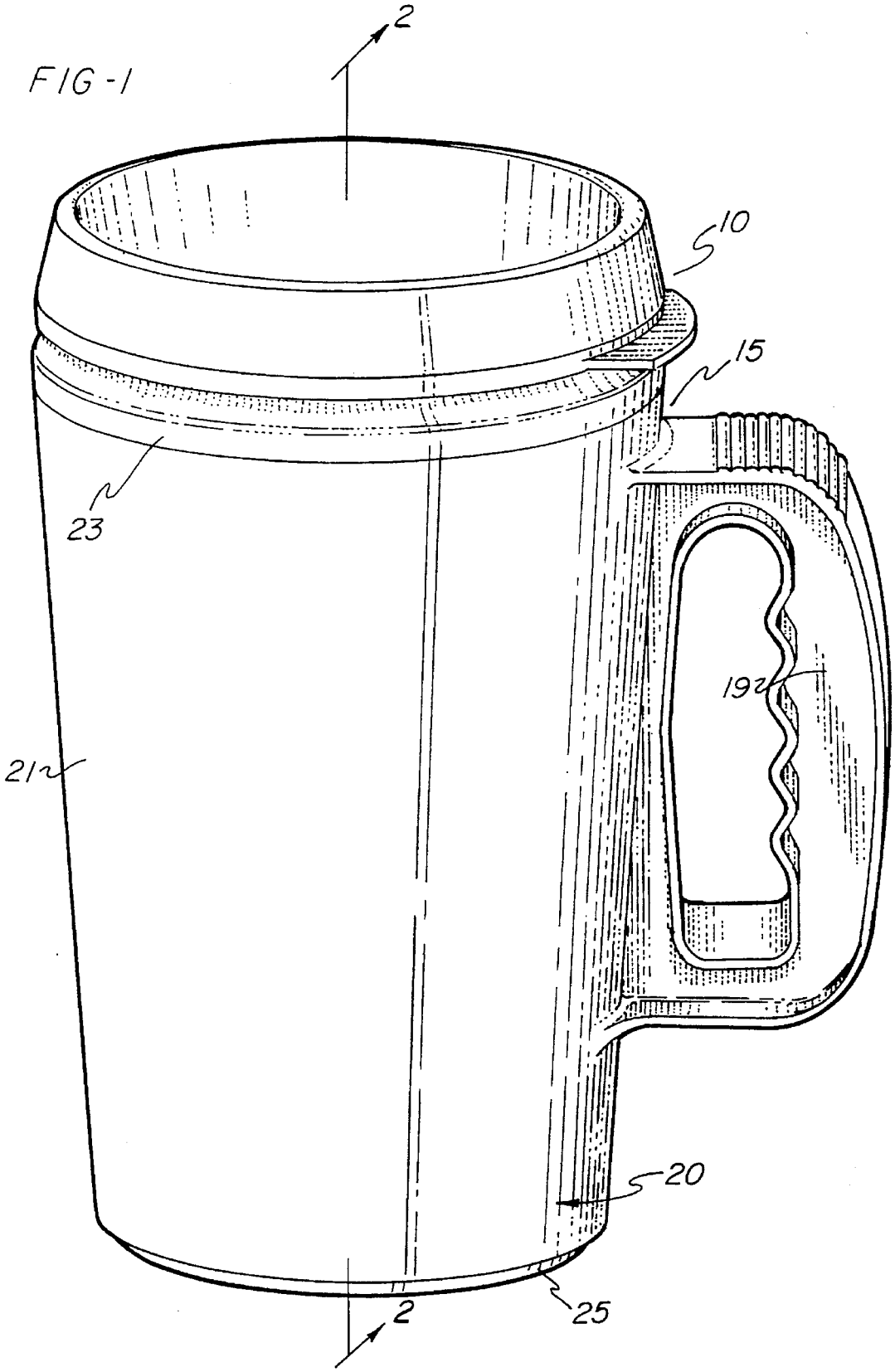
FIG. 1 is a perspective view of a beverage container cap embodying my new invention in its operative position atop a beverage container.

Having reference to the drawing figures, attention is first directed to FIG. 1 which discloses a beverage container cap embodying the invention with the beverage container cap being designated generally by the numeral 10. It will be noted that the beverage container cap assembly 10 is shown as being used on a particular type of beverage container 15, namely a mug or cup, preferably having a handle 19.

However, FIG. 1 is for illustrative purposes only, and thus it should be understood that other types of beverage containers could be used with the cap of this invention. Additionally, other specific cup or mug structures could be used with a cap which embodies this invention. Regardless of the specific configuration, as can be appreciated from comparing FIGS. 1 and 2, the beverage container would comprise a container sidewall 20 having a container outer surface 21, a container top edge 23, and a container bottom 25.

The cap itself is formed having an outer sidewall 30 which inclines upwardly and inwardly, a curved upper edge 32 at the apex of the outer sidewall 30, a sloped inner sidewall 34 which slopes downwardly and inwardly from the curved upper edge, and an inclined base 36 at the bottom of the sloped inner sidewall. This inclined base 36 includes a cap vent hole 38, which is preferably circular and which is located a distance centrally of the juncture of the sloped inner sidewall and the inclined base. The inclined base also includes a drink aperture 40 which is preferably a curved opening or slot immediately adjacent the juncture of the sloped inner sidewall and the inclined base. As can best be appreciated from a comparison of FIGS. 2 and 3, the cap vent hole 38 and the drink aperture 40 are preferably on the same axis, with the cap vent hole being offset from the actual center of the inclined base.

The cap 10 also is shown having a cap flange member 45 which assists in the removal of the cap 10 from the beverage container 15. This cap flange member 45 is at outer sidewall bottom edge 42, and preferably is on the same axis as the cap vent hole 38 and drink aperture 40.

Figure 2:
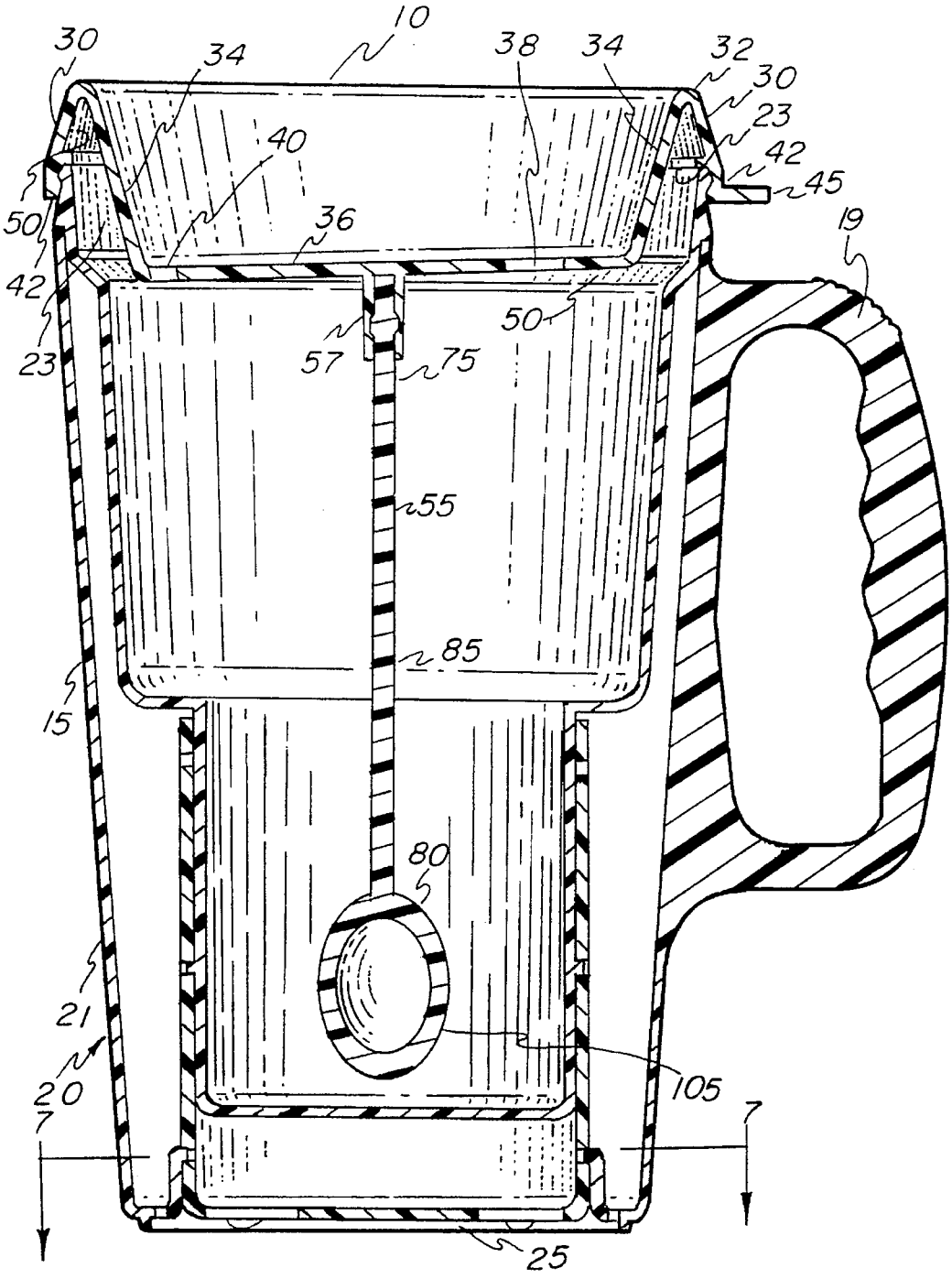
FIG. 2 is a vertical sectional view taken along line 3—3 of FIG. 1.
Figure 3:
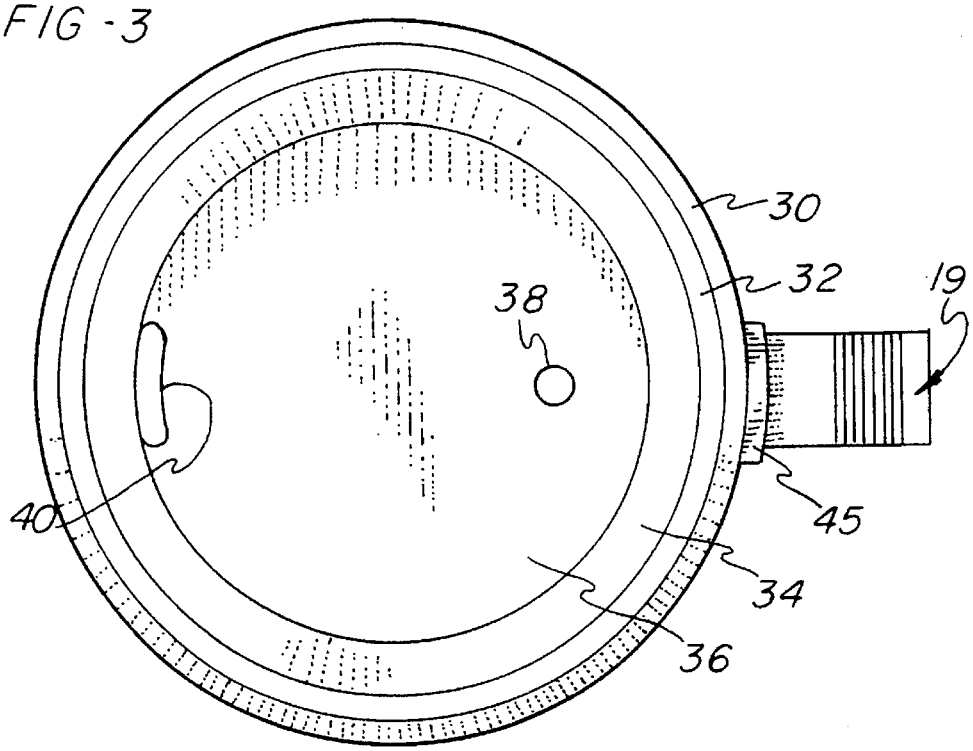
FIG. 3 is a top plan view.

As can be appreciated from FIG. 2, the cap has an inner surface 50, with a stirrer 55 downwardly depending therefrom. The stirrer is attached to a stirrer receptacle 57 which preferably is formed as part of the inner surface 50 of the cap 10. Preferably the stirrer receptacle is generally cylindrical.

Figure 4:
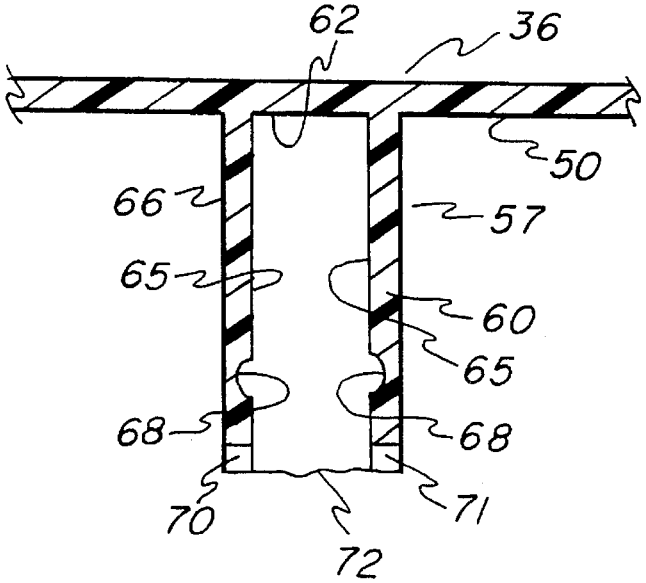
FIG. 4 is a vertical sectional view on a greatly enlarged scale of the stirrer receptacle shown in FIG. 3.
Figure 7:
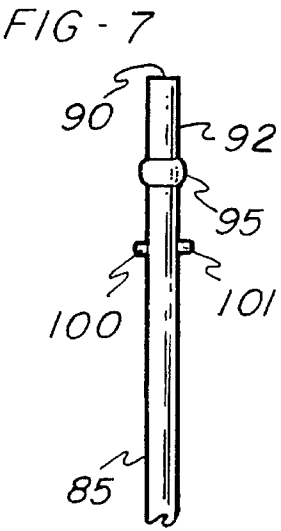
FIG. 7 is a perspective view taken on a greatly enlarged scale of the shank portion of the stirrer.
Figure 6:
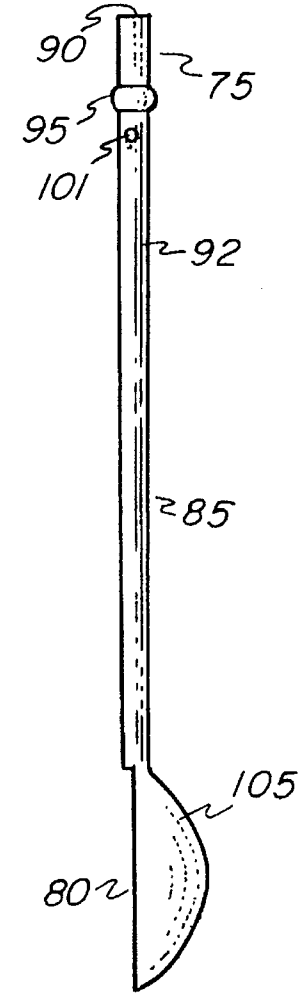
FIG. 6 is an elevational view taken from the right side of FIG. 5.
Figure 5:
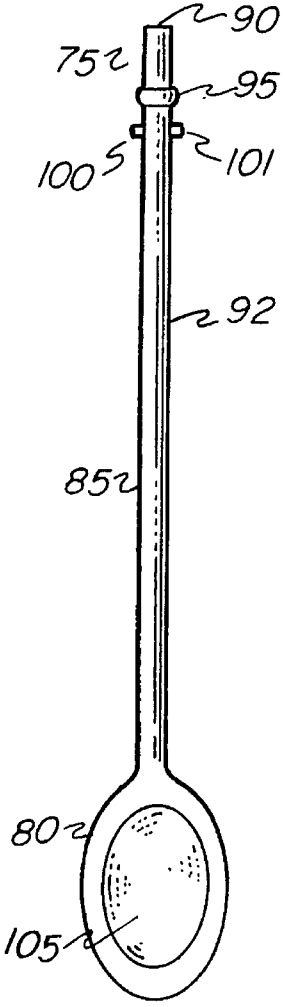
FIG. 5 is front elevational view of the stirrer associated with the present invention.

The structure of the stirrer receptacle can be best appreciated from a comparison of FIGS. 2 and 4. The stirrer receptacle 57 is formed having a stirrer receptacle sidewall 60. The stirrer receptacle has an upper surface 62, with the thickness of the inclined base 36 directly above the upper surface 62 being the stone as the thickness of the inclined base adjacent the juncture of the sloped inner sidewall 34 and the inclined base.

The stirrer receptacle has both an inner surface 65 and an outer surface 66, with a groove or indentation 68 in the inner surface located at approximately the vertical mid-point of the stirrer receptacle. A pair of notches 70 and 71 are located at the bottom edge 72 of the stirrer receptacle 57.

The structure of the stirrer 55 associated with this invention may best be appreciated from a comparison of FIGS. 2, 5, 6, and 7. It has a shank end 75, a terminal end 80 and a shaft portion 85. The shaft portion is located between the shank end and the terminal end, and connects the two.

The stirrer 55 has a top 90, and a sidewall 92. A bulge 95 in the sidewall 92 is located a short distance below the top 90, with that distance being less than the distance between the top surface 62 and the groove 68. Additionally, the shank end 75 of the stirrer has at least one, and preferably two, nubs 100 and 101 projecting outwardly from the stirrer. In the preferred embodiment of the invention, at the terminal end 80 of the stirrer 55 is a bowl portion 105.

The two hubs 100, 101 are preferably located the same distance from the bulge 95 as notches 70, 71 are from the indentation 68. Additionally, the two hubs 100, 101 are preferably located on opposite sides of the stirrer. Similarly, the two notches 70, 71 are preferably located on opposite sides of the stirrer receptacle. In the preferred embodiment of the invention the assembled cap has the stirrer 55 mechanically engaged in the stirrer receptacle 57 with the bulged area 95 positioned in the groove 68, and with the nubs 100, 101 positioned in the notches 70, 71 respectively.

In the preferred embodiment of the invention, the entire beverage container cap and stirrer is fabricated from plastic, preferably polypropylene. The choice of manufacturing material permits the product to be fabricated using existing technology as well as from a relatively inexpensive starting material. The choice of plastic should be one which will be resistant to the heat of the beverage.

The preferred dimensions associated with this invention include a distance from the container top edge to the container bottom edge of approximately 5.9", and an inner diameter across the top of the open container of 3.84". The diameters associated with the outer sidewall of the cap are an inner diameter of about 3.98" and an outer diameter of about 4.17". The outer sidewall is inclined upwardly and inwardly 15° from vertical, while the sloped inner sidewall is inclined upwardly and outwardly 15° from vertical. The vertical distance from the upper edge to the outer sidewall bottom edge is about 0.67".

The diameter across the cap at its upper edge is about 3.61". The inclined base has a preferred inclination of 2° from horizontal, with the vertical distance from the uppermost edge of the inclined base to the upper edge of the cap being about 1". The cap flange member is about 0.75" wide and extends outwardly from the outer sidewall about 0.25". The cap vent hole has a diameter of about 0.185", and the drink aperture is about 0.17" wide and extends along the inclined base at its juncture with the sloped inner sidewall through an arc of about 30°.

The stirrer receptacle has an inner diameter of about 0.125", an outer diameter of about 0.21", and extends downwardly from the inner surface of the cap a distance of approximately 0.55". The indentation in the stirrer receptacle is located about 0.175" from the bottom of the receptacle, and the notches extend upwardly a distance of about 0.06".

The stirrer is about 4.8" long and about 0.125" in its outer diameter. The bulge is about 0.36" from the top of the shank end, and the nubs are about 0.51" from the top of the shank end. The nubs preferably are 0.05" in diameter, and extend outwardly from the sidewall of the stirrer a distance of about 0.04". The bowl portion of the stirrer is preferable generally oval in shape with a width of about 0.77", a heighth of about 1", and a depth of about 0.35".

In actual use, once a beverage is deposited into the beverage container, if it needs stirring, the cap itself., prior to replacing it atop the beverage container, may be held like a handle as the stirrer is made to pass through the beverage. When the stirring process is completed, the cap is replaced. For thorough cleaning of the cap, the stirrer is detached from the stirrer receptacle, the cap and stirrer are cleaned, and the cap is reassembled.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A drink container cap, said cap comprising an exterior surface, and an interior surface, said interior surface having a stirrer depending downwardly therefrom, said stirrer having a shank end, said cap having formed therein a stirrer receptacle having an inner surface, said stirrer being mechanically retained within said stirrer receptacle by cooperation between said shank end and said inner surface, said stirrer receptacle having a bottom edge, said stirrer receptacle having at least one notch formed in said bottom edge, said stirrer having at least one projection extending outwardly therefrom, said projection configured to fit within said notch.

2. The drink container cap according to claim 1 wherein said stirrer receptacle is generally cylindrical.

3. The drink container cap according to claim 2 wherein said stirrer is detachable from said stirrer receptacle.

4. The drink container cap according to claim 1 wherein said stirrer receptacle has two notches formed therein, and said stirrer has two projections extending outwardly from said shank end, said notches being on opposite sides of said stirrer receptacle and said projections being on opposite sides of said stirrer.

5. The drink container cap according to claim 1 wherein said stirrer receptacle has an indention in its inner surface, said shank end has a top, said shank end has a bulged area located a distance below said top, said bulged area engaging with said indentation.

6. The drink container cap according to claim 5 wherein said stirrer has at least one projection extending outwardly therefrom, said projection configured to fit within said notch, said projection located the same distance from the bulged area as said notch is from said indention.

7. The drink container cap according to claim 1 wherein said bottom edge is spaced apart from said interior surface.

8. A drink container cap, said cap comprising an exterior surface, and an interior surface, said interior surface having a stirrer receptacle formed therein having an inner surface, said stirrer receptacle engaging with a stirrer, said stirrer having a shank end, said stirrer being retained within said stirrer receptacle by cooperation between said shank end and said inner surface, said stirrer receptacle having a bottom edge, said stirrer receptacle having at least one notch formed in said bottom edge, said stirrer having at least one projection extending outwardly therefrom, said projection configured to fit within said notch.

9. The drink container cap according to claim 8 wherein said stirrer receptacle is generally cylindrical.

10. The drink container cap according to claim 8 wherein said stirrer is detachable from said stirrer receptacle.

11. The drink container cap according to claim 8 wherein said stirrer receptacle has two notches formed therein, and said stirrer has two projections extending outwardly from said shank end, said notches being on opposite sides of said stirrer receptacle and said projections being on opposite sides of said stirrer.

12. The drink container cap according to claim 8 wherein said stirrer receptacle has an indention in its inner surface, said shank end has a top, said shank end has a bulged area located a distance below said top, said bulged area engaging with said indentation.

13. The drink container cap according to claim 12 wherein said stirrer has at least one projection extending outwardly therefrom, said projection configured to fit within said notch, said projection located the same distance from the bulged area as said notch is from said indention.

14. The drink container cap according to claim 8 wherein said bottom edge is spaced apart from said interior surface.

15. A drink container cap, said cap comprising an exterior surface, and an interior surface, said interior surface having a stirrer receptacle engaging with a stirrer, said stirrer receptacle having an inner and an outer surface, said outer surface located below said interior surface, said stirrer receptacle having an indentation in its inner surface, said stirrer receptacle having a bottom edge spaced apart from said interior surface, said stirrer having a shank end and a terminal end, said shank end having a top in addition to a bulged area located a distance below said top, which bulged area engages with said indentation, said terminal end having a bowl portion.

16. The drink container cap according to claim 15 wherein said stirrer receptacle has two notches formed therein, and said stirrer has two projections extending outwardly from said shank end, said notches being on opposite sides of said stirrer receptacle and said projections being on opposite sides of said stirrer.

* * * * *